US010712093B2

(12) United States Patent
Chen et al.

(10) Patent No.: US 10,712,093 B2
(45) Date of Patent: Jul. 14, 2020

(54) KILN CAR AND KILN FOR FIRING CERAMIC BODIES

(71) Applicant: Corning Incorporated, Corning, NY (US)

(72) Inventors: Peng Chen, Painted Post, NY (US); Jeffrey Siler White, Corning, NY (US); Christopher Steven Witte, Beaver Dams, NY (US)

(73) Assignee: Corning Incorporated, Corning, NY (US)

( * ) Notice: Subject to any disclaimer, the term of this patent is extended or adjusted under 35 U.S.C. 154(b) by 152 days.

(21) Appl. No.: 15/756,868

(22) PCT Filed: Aug. 29, 2016

(86) PCT No.: PCT/US2016/049209

§ 371 (c)(1),
(2) Date: Mar. 1, 2018

(87) PCT Pub. No.: WO2017/040377

PCT Pub. Date: Mar. 9, 2017

(65) Prior Publication Data

US 2018/0266766 A1 Sep. 20, 2018

Related U.S. Application Data

(60) Provisional application No. 62/213,953, filed on Sep. 3, 2015.

(51) Int. Cl.
*F27D 3/12* (2006.01)
*F27B 9/10* (2006.01)
(Continued)

(52) U.S. Cl.
CPC ..... *F27D 3/123* (2013.01); *F27B 9/10* (2013.01); *F27D 5/0006* (2013.01); *F27D 5/0031* (2013.01); *F27B 2009/3638* (2013.01)

(58) Field of Classification Search
CPC ..... F27B 19/02; F27D 3/12; F27D 3/123
See application file for complete search history.

(56) References Cited

U.S. PATENT DOCUMENTS 4,721,460 A * 1/1988 Bushman ..... F27B 9/262 432/241
4,927,577 A 5/1990 Ohtaka et al.
(Continued)

FOREIGN PATENT DOCUMENTS

CN 202648381 U 1/2013
CN 203534156 U 4/2014
(Continued)

OTHER PUBLICATIONS

Abou-Ziyan; "Convective Heat Transfer From Different Brick Arrangements in Tunnel Kilns"; Applied Thermal Engineering, 24 (2004) pp. 171-191.
(Continued)

*Primary Examiner* — Gregory A Wilson
(74) *Attorney, Agent, or Firm* — Joseph M. Homa

(57) ABSTRACT

A kiln car assembly for a firing kiln having a plurality of upper burners includes a kiln car with an uppermost plurality of ceramic green bodies, a plurality of vertical members, and a horizontal supporting plate for supporting the ceramic green bodies during a firing process in the kiln. Further, the kiln car assembly includes a covering table having a tabletop located between the uppermost plurality of ceramic green bodies and the upper burners, and a plurality of legs positioned on the horizontal supporting plate.

11 Claims, 8 Drawing Sheets

(51) Int. Cl.
*F27D 5/00* (2006.01)
*F27B 9/36* (2006.01)

(56) References Cited

U.S. PATENT DOCUMENTS

| | | | | |
|---|---|---|---|---|
| 4,979,895 | A * | 12/1990 | Yasuda | B28B 11/243 432/10 |
| 5,112,223 | A | 5/1992 | Walle et al. | |
| 5,168,036 | A | 12/1992 | Doby, Jr. | |
| 5,316,710 | A | 5/1994 | Tasaki et al. | |
| 5,378,144 | A | 1/1995 | Cress | |
| 5,890,890 | A * | 4/1999 | Groom | F27B 9/021 432/121 |
| 7,637,739 | B2 * | 12/2009 | Nowakowski | F23C 6/045 264/652 |
| 7,976,768 | B2 | 7/2011 | Brady et al. | |
| 8,138,108 | B2 | 3/2012 | Tepesch et al. | |
| 8,192,680 | B2 | 6/2012 | Chan et al. | |
| 2007/0104816 | A1 | 5/2007 | Woodside et al. | |
| 2008/0116621 | A1 * | 5/2008 | Brennan | F27B 9/10 264/606 |
| 2014/0327191 | A1 | 11/2014 | Suzuki et al. | |

FOREIGN PATENT DOCUMENTS

| | | | | |
|---|---|---|---|---|
| CN | 203534162 | U | 4/2014 | |
| DE | 4121118 | A1 | 2/1992 | |
| EP | 0335615 | A2 * | 10/1989 | B28B 11/243 |
| EP | 0535871 | A1 | 9/1992 | |
| EP | 2568244 | A1 | 3/2013 | |

OTHER PUBLICATIONS

Dugwell et al; "A Model of Heat Transfer in Tunnel Kilns Used for Firing Refractories"; Int. J. Heat Mass Transfer; vol. 31, No. 11, (1988) pp. 2381-2390.

Halasz et al; "Energy-Optimal Operation Conditions of a Tunnel Kiln"; Comput. Chem. Engng., vol. 12, No. 2/3, (1988) pp. 183-187.

International Search Report and Written Opinion of the International Searching Authority; PCT/US2016/049209; dated Nov. 7, 2016; 19 pages; European Patent Office.

Kaya et al; "Model-Based Optimization of Heat Recovery in the Cooling Zone of a Tunnel Kiln"; Applied Thermal Engineering, 28 (2008); pp. 633-641.

Kaya et al; "Modelling and Optimization of the Firing Zone of a Tunnel Kiln to Predict the Optimal Feed Locations and Mass Fluxes of the Fuel and Secondary Air"; Applied Energy, 86, (2009) pp. 325-332.

* cited by examiner

KILN CAR AND KILN FOR FIRING CERAMIC BODIES

CROSS-REFERENCE TO RELATED APPLICATIONS

This is a national stage application under 35 U.S.C. § 371 of International Application No. PCT/US2016/049209, filed on Aug. 29, 2016 which claims the benefit of priority of U.S. Provisional Application Ser. No. 62/213,953 filed on Sep. 3, 2015, the contents of which are relied upon and incorporated herein by reference in their entirety.

FIELD

The present disclosure generally relates to kilns and kiln furniture, assemblies and cars for firing ceramic bodies and, more particularly, for firing ceramic honeycomb structures for use in vehicular exhaust systems.

BACKGROUND

Efforts to reduce atmospheric pollution include the placement of a honeycomb ceramic body into the exhaust system of vehicles having internal combustion engines to minimize hazardous emissions including particulate matter.

SUMMARY

As used herein, "ceramic green body" can be a green body comprising a ceramic-forming material, or a ceramic material, or a combination thereof.

According to an aspect of the disclosure, a kiln car for a firing kiln having a plurality of upper burners is disclosed herein comprising an uppermost section for holding an uppermost plurality of ceramic green bodies during a firing process in the kiln, a plurality of vertical members, and a horizontal supporting plate for supporting the ceramic green bodies during the firing process. The uppermost section comprises a covering element located between the uppermost plurality of ceramic green bodies and the upper burners.

According to another aspect, a kiln car assembly for a firing kiln having a plurality of upper burners includes a kiln car comprising an uppermost plurality of ceramic green bodies, a plurality of vertical members, and a horizontal supporting plate for supporting the ceramic green bodies during a firing process in the kiln. Further, the kiln car assembly includes a covering table comprising a tabletop located between the uppermost plurality of ceramic green bodies and the upper burners, and a plurality of legs positioned on the horizontal supporting plate.

In certain aspects of the disclosure, the kiln car and kiln car assembly can be configured such that the respective covering element or covering table is adapted to control the maximum temperature differential between the topmost surface of the uppermost plurality of ceramic green bodies and a region in the kiln above the topmost surface of the uppermost plurality of ceramic green bodies during the firing process. Some implementations of the kiln car and kiln car assembly employ respective covering elements or covering tables adapted to control the maximum temperature differential to 100° C. or less and, even more preferably, to 50° C. or less during firing runs.

According to some aspects of the disclosure, the kiln car and kiln car assembly are configured such that their respective covering elements or covering tables are spaced above the uppermost plurality of ceramic green bodies by a distance D1, in which D1 is set between about 1 mm and about 100 mm. Similarly, the respective covering elements and covering tables employed in these kiln cars and kiln car assemblies of the disclosure can be spaced from the upper burners in the kiln by a minimum distance D2, in which D2 is set between about 50 mm and about 300 mm. Further, the thickness of the respective covering elements and covering tables may be set between about 1 mm and 25 mm.

According to a further aspect, a firing kiln for firing ceramic green bodies includes: a furnace enclosure having a floor, a ceiling and a plurality of side walls; a plurality of upper burners arranged in proximity to the ceiling; and a plurality of hanging plates coupled to the ceiling or at least one of the side walls. Further, the burners and the enclosure are adapted for firing a batch of ceramic green bodies positioned on a kiln car, the batch comprising an uppermost plurality of ceramic green bodies. In addition, the plurality of hanging plates is located between the uppermost plurality of ceramic green bodies and the respective plurality of upper burners such that each upper burner is at least partially enclosed by one of the hanging plates.

In one aspect of the firing kiln of the disclosure, the kiln can be configured such that its hanging plates are adapted to control the maximum temperature differential between the topmost surface of the uppermost plurality of ceramic green bodies positioned on the kiln car within the kiln and a region in the kiln above the topmost surface of the uppermost plurality of ceramic green bodies during the firing process. Some implementations of the kiln employ hanging plates adapted to control the maximum temperature differential to 100° C. or less and, even more preferably, to 50° C. or less during firing runs.

In another aspect of the disclosure, the kiln can be configured such that its hanging plates are spaced above the uppermost plurality of ceramic green bodies by a distance D1, in which D1 is set between about 1 mm and about 100 mm. Similarly, the hanging plates employed in these kilns can be spaced from the upper burners by a minimum distance D2, in which D2 is set between about 50 mm and about 300 mm. Further, the thickness of the hanging plates may be set between about 1 mm and 25 mm.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
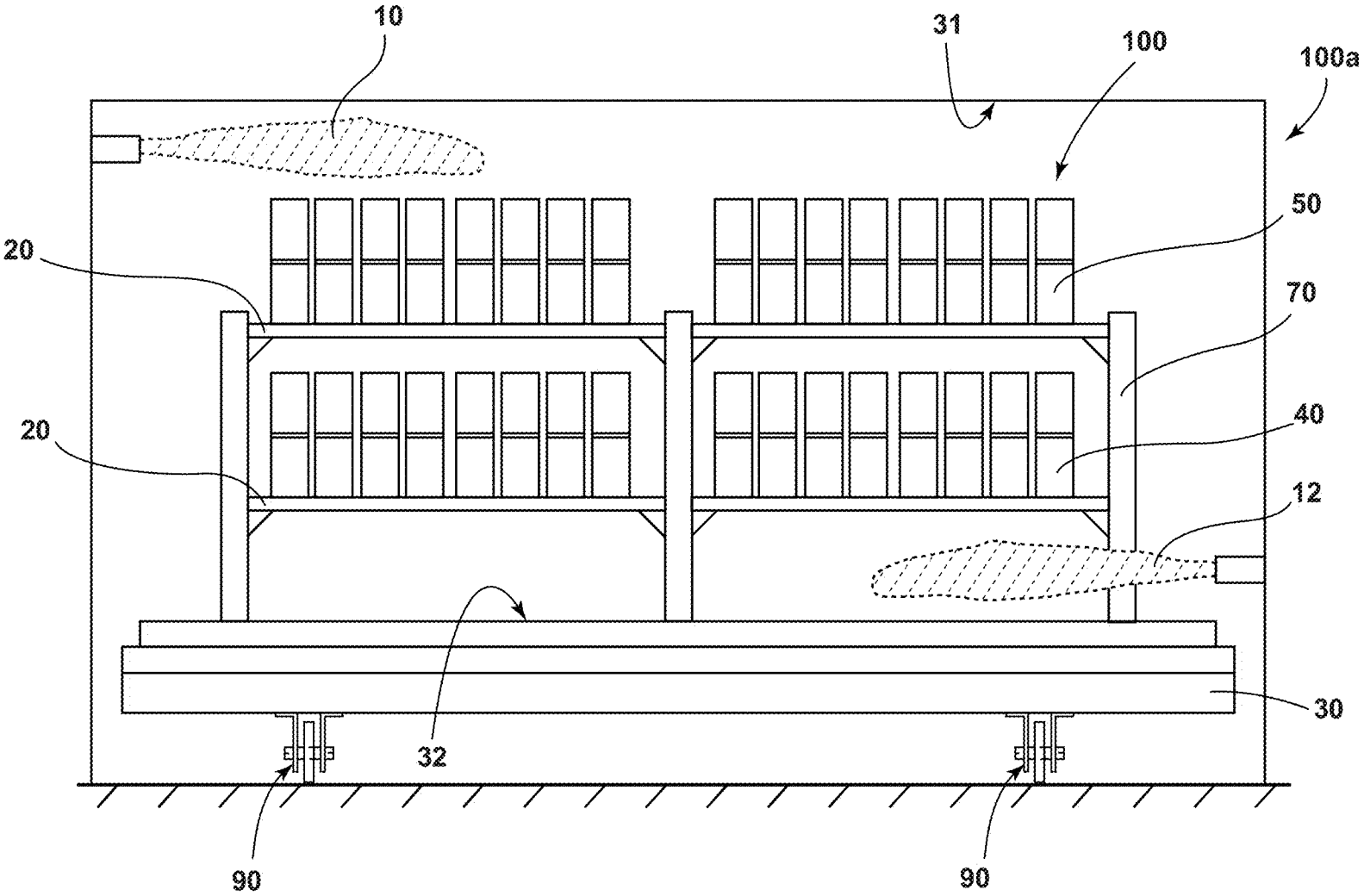
FIG. 1 (PRIOR ART)
FIG. 1 is a schematic front view of a cross-section of a tunnel kiln with a conventional kiln car holding ceramic green bodies during a firing process.

It is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Ceramic honeycomb structural bodies may be prepared from a ceramic or ceramic-forming green body. As used herein, "ceramic green body" can be a green body comprising a ceramic-forming material, or a ceramic material, or a combination thereof.

These green bodies can be formed by mixing ceramic raw materials with water and various carbonaceous materials to form a plasticized batch. The batch can then be extruded into a near-final shape form and then fired at elevated temperatures in a kiln to oxidize or otherwise volatize the carbonaceous components of the batch and to form the final ceramic honeycomb structure.

During the firing process, green bodies can crack in a variety of ways. Efforts to reduce cracking of the green bodies can include modifications to the firing schedules (e.g., temperatures, hold times, heating and cooling rates, etc.), compositional adjustments to the batch and/or reductions in compositional non-uniformities within each of the bodies. While these approaches can improve the firing yield for certain ceramic honeycomb structure products, losses in manufacturing yield from cracking of ceramic green bodies may persist.

In some embodiments, approaches are disclosed herein to improve ceramic body firing yields, sometimes without requiring significant modifications to the composition of the green bodies and/or the firing schedules employed to convert the green bodies into final ceramic structures.

This disclosure includes various approaches to improve ceramic body firing yields. These approaches include kiln, kiln car and kiln car assembly configurations that can be employed to reduce or otherwise eliminate cracking of ceramic green bodies during firing processes. Advantageously, these approaches do not require significant modifications to the composition of the green bodies and/or the firing schedules employed to convert the green bodies into final ceramic structures, including honeycomb structures suitable for reducing hazardous automotive emissions. Furthermore, these kiln and kiln furniture configurations require minimal increases in costs over conventional configurations that are easily offset by manufacturing yield increases. Still further, some aspects of the kilns and kiln furniture disclosed herein can be easily retrofit to existing kilns and kiln furniture.

Ceramic green body cracking may be the result of large temperature gradients that develop within the ceramic green bodies during the firing process. Some factors can influence green body cracking rates (e.g., compositional non-uniformities, firing temperature and time profiles, etc.), but in some embodiments a more effective approach to reducing crack rates may be obtained with the recognition that temperature gradients that develop within the green bodies during firing, particularly over short time periods, may more significantly influence cracking rates. For example, the green bodies in proximity to the burners employed in the firing kiln can be prone to larger temperature gradients in comparison to other bodies within the same kiln given the significantly higher (or lower) temperatures of the burners in comparison to the green bodies during the firing process. In periodic kilns, such temperature gradients may be minimized by movement of the green bodies to locations within the kiln away from direct exposure to the burners without a significant loss in batch sizes, which correlate to manufacturing throughput. In tunnel kilns, however, burners are generally located in close proximity to many green bodies and manufacturing throughput would be severely decreased by moving the green bodies away from the burners. In addition, the movement of the green bodies through the tunnel kilns during firing may result in a periodic or cyclic exposure of many of the green bodies to temperature gradients associated with being in proximity to particular burners and/or between burners during stages of a given firing process.

The final ceramic products disposed in the kiln and on or around kiln furniture in this disclosure generally may comprise a honeycomb shape, or otherwise may consist of ceramic honeycomb structures or ceramic cellular bodies. These structures can be prepared from a ceramic green body which may be formed through mixing of ceramic materials with water and various carbonaceous materials, including extrusion and forming aids to form a plasticized batch, forming the body into a honeycomb-shaped ceramic green body through extrusion of the plasticized batch, and finally firing the honeycomb-shaped ceramic green body in the firing kiln. Various such green body compositions and ceramic product forming methods according to this disclosure are detailed in U.S. Pat. No. 8,138,108, issued on Mar. 20, 2012, U.S. Pat. No. 8,192,680, issued on Jun. 5, 2012 (see FIG. 1 and its corresponding description), and International Publication No. WO 2006/130759, published on Dec.

7, 2012, the salient portions of which associated with such green body compositions and forming methods are hereby incorporated by reference within this disclosure.

Carbonaceous material release or the decomposition of the carbonaceous material is an oxidation or exothermic reaction which releases large amounts of heat during the firing process. Initially the exothermic reaction may occur at the outer wall or outer portion of the part, resulting in an initial thermal differential whereby the outer portion of the ceramic body (e.g., ceramic green bodies 40, 50 depicted in FIG. 1) is hotter than an interior portion, such as the core of a honeycomb structure; subsequently, the skin or outer portion exothermic reaction dies down, and the exothermic reaction region moves into the interior of the ware. Difficulties may be encountered in effectively removing, either by conduction or convection, the heat from the ceramic body due to the fact that typical structures or substrates are comprised of ceramic materials, for example cordierite, which are good insulators, and exhibit a cellular structure comprising numerous channels. Additionally, there may be considerable surface area to promote binder reaction with the $O_2$ in the firing atmosphere due to the extensive cellular structure, thus exacerbating this interior exothermic effect. As such, during carbonaceous material release, the ceramic body may exhibit either a positive or negative thermal differential, i.e., the core of the ceramic body exhibiting either a higher or lower temperature than that of the ceramic at or near the surface. This exothermic reaction, which may occur between 100° C. to 600° C. for carbonaceous materials such as an organic binder and the like, or in the range of 500° C. to 1000° C. if the body contains, for example, graphite, causes a significant temperature differential between the inside and outside of the part. This temperature differential in the part may create stresses in the ceramic body which may result in cracking of the part. This phenomenon may be more of an issue for large cellular ceramic parts or parts containing large amounts of organic materials.

Figure 1A:
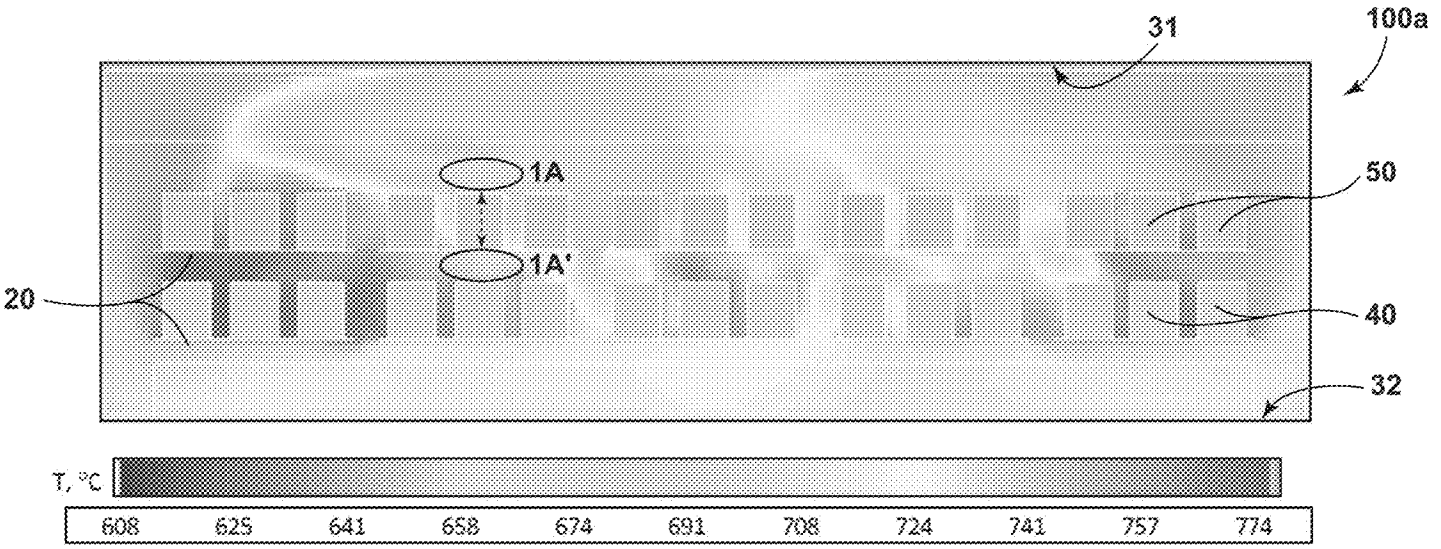
FIG. 1A (PRIOR ART)
FIG. 1A is a temperature profile schematic of a cross-section of the tunnel kiln and conventional kiln car depicted in FIG. 1 at an axial location in the kiln between burners.
Figure 1B:
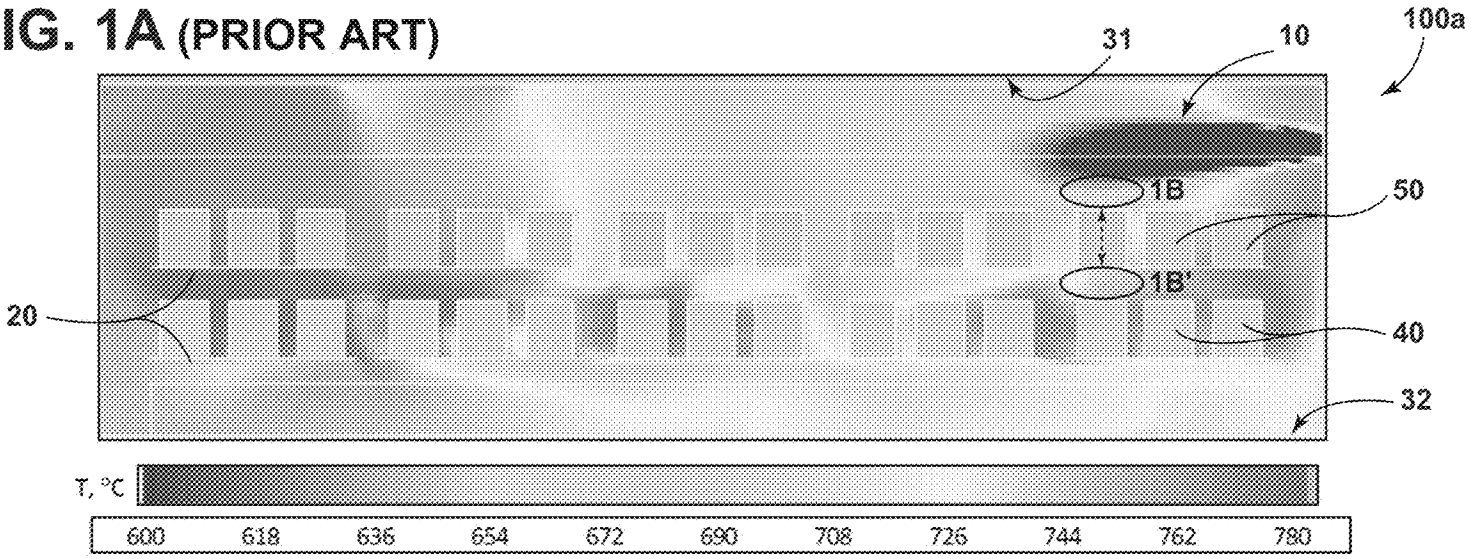
FIG. 1B (PRIOR ART)
FIG. 1B is a temperature profile schematic of a cross-section of the tunnel kiln and conventional kiln car depicted in FIG. 1 at an axial location in the kiln in proximity to an upper burner.

Referring to FIGS. 1, 1A and 1B, these schematics of a tunnel kiln 100*a* illustrate development of temperature gradients in green bodies during firing that may result in high crack rates and low manufacturing yields. Tunnel kiln 100*a* possesses a ceiling 31, along with multiple upper burners 10 and multiple lower burners 12 coupled or otherwise situated along walls of the kiln, periodically spaced along the length or axial direction of the kiln (not shown). A kiln car 100 containing ceramic green bodies 40 and uppermost ceramic green bodies 50 moves through the kiln 100*a* in an axial direction between its walls and beneath its ceiling 31.

As depicted in FIG. 1, the kiln car 100 comprises vertical members 70, and horizontal support plates 20 arranged between the members 70 that provide support for the ceramic green bodies 40, 50 during the firing process. The kiln car 100 also comprises a floor 32 and base 30 that provides support for the vertical supports 70. Attached to the base 30 are wheels 90 that allow for axial motion of the kiln car 100 within the kiln 100*a*. As the kiln car 100 moves within the kiln 100*a* in an axial direction along its wheels 90 during the firing process, it periodically passes in closer proximity to an upper burner 10 and/or a lower burner 12. As such, certain quantities of green bodies 40 and/or bodies 50 pass within close proximity to a particular burner 10, 12 and then move away from the burner as the kiln car 100 continues to move in an axial direction within the tunnel kiln 100*a* during the firing process.

FIGS. 1A and 1B depict one example of temperature profiles of a cross-section of the tunnel kiln 100*a* and the kiln car 100 at two respective axial locations in the kiln. In FIG. 1A, the kiln 100*a* is loaded with a kiln car having uppermost ceramic green bodies 50 and lower green bodies 40. The green bodies 50, 40 rest on horizontal plate 20 of the kiln car. The axial location within the tunnel kiln 100*a* associated with FIG. 1A is between burners 10, 12. Nevertheless, a temperature gradient of at least 100° C., for example, may exist between a region above certain uppermost green bodies 50 (e.g., a region subject to gas flow within the kiln) and locations within the bodies themselves (see region 1A to 1A' in FIG. 1A). These temperature gradients result in thermal stresses within the bodies, some of which may cause the bodies 50 to crack during firing processes in the tunnel kiln 100*a*.

With regard to FIG. 1B, the axial location within the tunnel kiln 100*a* is in proximity to burner 10. A temperature gradient of at least 100° C., for example, may exist between a region above certain uppermost green bodies 50 (e.g., a region subject to gas flow within the kiln and in close proximity to burner 10) and locations within the bodies themselves (see region 1B to 1B' in FIG. 1B). These temperature gradients result in thermal stresses within the bodies, some of which cause the bodies 50 to crack during firing processes in the tunnel kiln 100*a*. In addition, it is evident from FIGS. 1A and 1B that the temperature profiles in the ceramic green bodies 50, 40 may fluctuate as a function of axial position within the tunnel kiln 100*a* during a firing process, leading to cyclic changes in thermal stresses within the bodies. As a result, cyclic thermal stress-induced cracking and propagation (e.g., fatigue effects) within the bodies may be another mechanism leading to cracking within the parts during the firing process.

Figure 2:
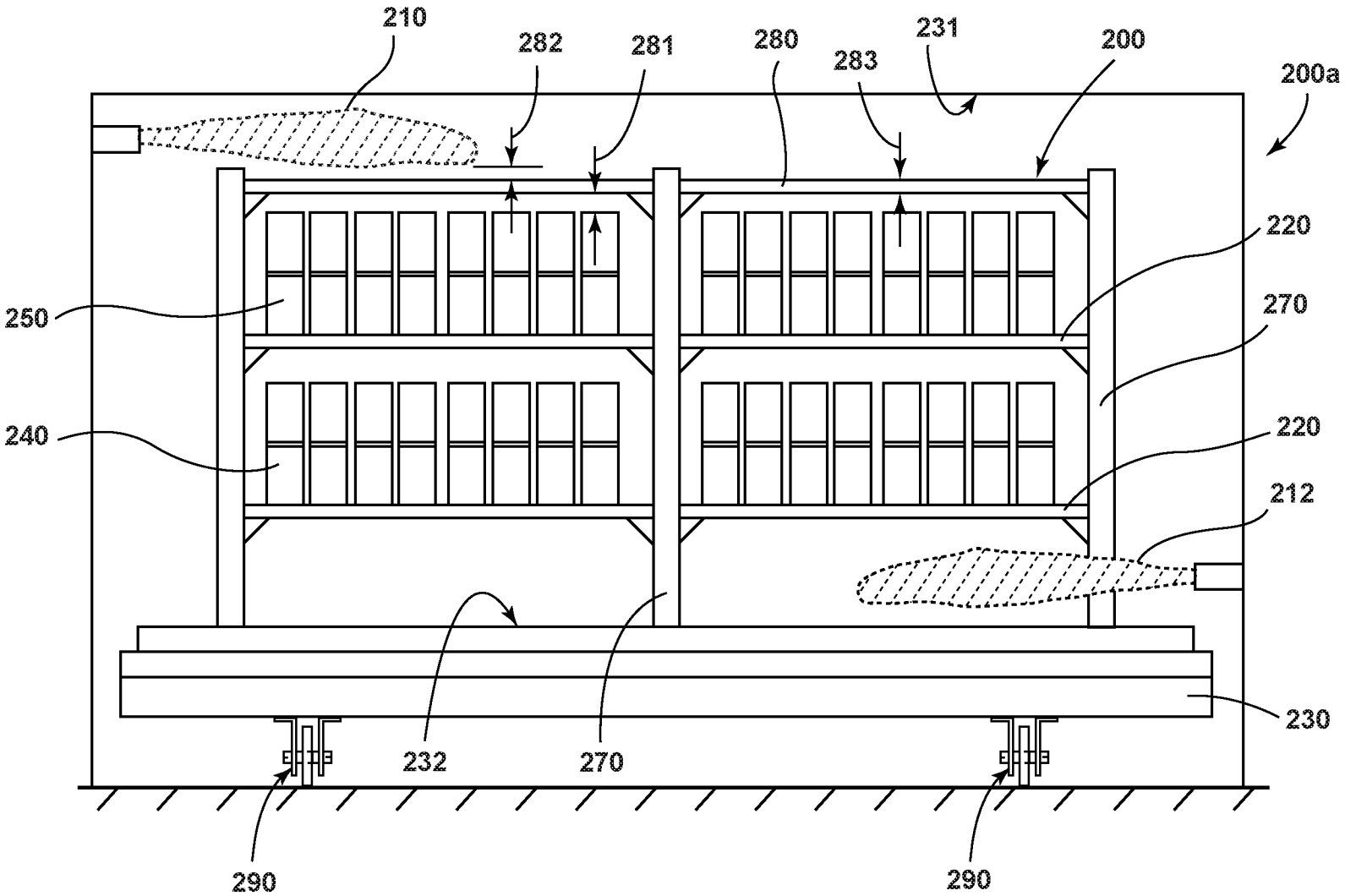
FIG. 2 is a schematic front view of a cross-section of a tunnel kiln with a kiln car holding ceramic green bodies during a firing process according to an aspect of the disclosure.

According to an aspect of the disclosure herein, the kiln car 200 shown in FIG. 2 can significantly help to reduce the cracking rates of ceramic green bodies associated with firing processes. In particular, FIG. 2 provides a schematic front view of a cross-section of a kiln 200*a* with the kiln car 200 holding ceramic green bodies 240, 250 during a firing process. The kiln 200*a* has a plurality of upper burners 210 and lower burners 212, each affixed to or otherwise emanating from sides of the kiln. The kiln 200*a* also includes a ceiling 231 and a kiln floor beneath the kiln car base 232, base 230, and wheels 290 of the kiln car 200. The kiln car 200 comprises an uppermost section for holding the uppermost plurality of ceramic green bodies 250 during a firing process in the kiln 200*a*. In certain embodiments, the kiln car 200 comprises one or more rows of lowermost ceramic green bodies 240 beneath the green bodies 250. The kiln car 200 also comprises a plurality of vertical members 270 and horizontal supporting plates 220 that rest or are otherwise supported by the members 270. The horizontal supporting plates 220 are for supporting the ceramic green bodies 240, 250 as shown in FIG. 2 during the firing process.

Kiln car 200 may be suitable for use in a kiln 200*a* configured as a periodic kiln, tunnel kiln or the like having a plurality of upper and lower burners (e.g., burners 210, 212) capable of firing ceramic green bodies as outlined in the disclosure. In general, the kiln car 200 and burners 210, 212 are configured such that the lowermost horizontal supporting plate 220 is above the lower burners 212 in the kiln 200*a* and the covering element 280 is beneath the upper burners 210 (see FIG. 2) as the kiln car 200 travels in an axial direction within the kiln 200*a*. While the temperature gradients experienced by the ceramic green bodies 240, 250 may not be as cyclic in nature when the kiln car 200 is employed in a periodic kiln as compared to a tunnel kiln, the kiln car 200 may still help in reducing the magnitude of the temperature gradients experienced by the ceramic green bodies during the firing process. Moreover, the kiln car 200 can provide further manufacturing flexibility for use in a periodic kiln as it possesses less thermal stress sensitivity associated with the distance between the burners and the ware (e.g., ceramic green bodies 240, 250) compared to conventional kiln cars.

Kiln car 200 may comprise one or refractory materials, including its horizontal plates 220 and vertical members 270. Various refractory materials as understood in the art can be employed in the components of the kiln car 200 including silicon carbide, graphite, carbon-carbon ceramic matrix composites, silicon carbide ceramic matrix composites, alumina, and other refractory ceramic and ceramic composite materials as understood in the field of the disclosure. In some embodiments, the materials employed in the kiln car 200 are sufficient to withstand repeated cycles of firing ceramic green bodies (e.g., bodies 240, 250) without degradation and have sufficient structural integrity to hold and support the bodies during a firing process.

Referring again to FIG. 2, the uppermost section of the kiln car 200 comprises a covering element 280 located between the uppermost plurality of ceramic green bodies 250 and the upper burners 210. The covering element 280 has a thickness 283 and is spaced above the uppermost ceramic green bodies 250 by a distance 281 (D1). Further, the covering element has a minimum spacing from the upper burners 210 in the kiln 200*a* by a distance 282 (D2). As the kiln car 200 moves through the kiln 200*a* in an axial direction, the spacing D2 increases as the covering element 280 and uppermost ceramic green bodies 250 move away from a given burner 210. As the kiln car 200 continues to progress in an axial direction through the kiln 200*a* during the firing process, the covering element 280 approaches another burner 210. As such, the spacing D2 reflects a minimum distance between the covering element 280 and each of the burners 210 within the kiln 200*a*.

The covering element 280 of the kiln car 200 can be fabricated from the same or similar refractory materials employed for the horizontal support plates 220 and vertical members 270. These refractory materials comprise silicon carbide, graphite, carbon-carbon ceramic matrix composites, silicon carbide ceramic matrix composites, alumina, and other refractory ceramic and ceramic composite materials as understood in the field of the disclosure. According to some aspects, the covering element 280 can be configured or otherwise fabricated with refractory materials selected primarily for thermal durability as the covering element 280 does not need to possess material properties sufficient for the element 280 to hold or otherwise support the ceramic green bodies 240, 250 during the firing process. As such, certain aspects of the kiln car 200 employ a covering element 280 fabricated from refractory materials that differ from those employed for the horizontal support plate 220 and the vertical members 270.

In some aspects of the kiln car 200 depicted in FIG. 2, the thickness 283 of the covering element 280 ranges between about 1 mm and about 25 mm. Certain implementations of the kiln car 200 possess a covering element having a thickness 283 between about 10 and 20 mm. In certain aspects of the kiln car 200, the thickness 283 of the covering element 280 can be minimized to reduce material costs and thermal mass. Accordingly the thickness 283 of the covering element 280 may be smaller than the corresponding thickness of the horizontal plates 220 employed in the kiln car 200.

Referring again to FIG. 2, aspects of the kiln car 200 employ a covering element 280 particularly adapted to control the maximum differential between the topmost surface of the uppermost ceramic green bodies 250 and a region in the kiln 200*a* above the topmost surface of these bodies 250. In particular, the covering element 280 can protect the bodies 250 from direct exposure to the burner 210 and thereby reduce the temperature differentials within the bodies 250 during the firing process within the kiln 200*a*. In certain aspects, the covering element 280 is adapted to control this maximum temperature differential to 100° C. or less. By reducing this temperature differential, the covering element 280 tends to reduce the thermal stresses that develop in the bodies 250 during the firing process. In turn, the reduction in thermal stresses leads to a reduction in the crack rate for the bodies 250 during each firing process. The covering element 280 also tends to reduce the temperature differentials within the lowermost ceramic green bodies 240, this leading to a reduction in the crack rate for these bodies as well.

Figure 2A:
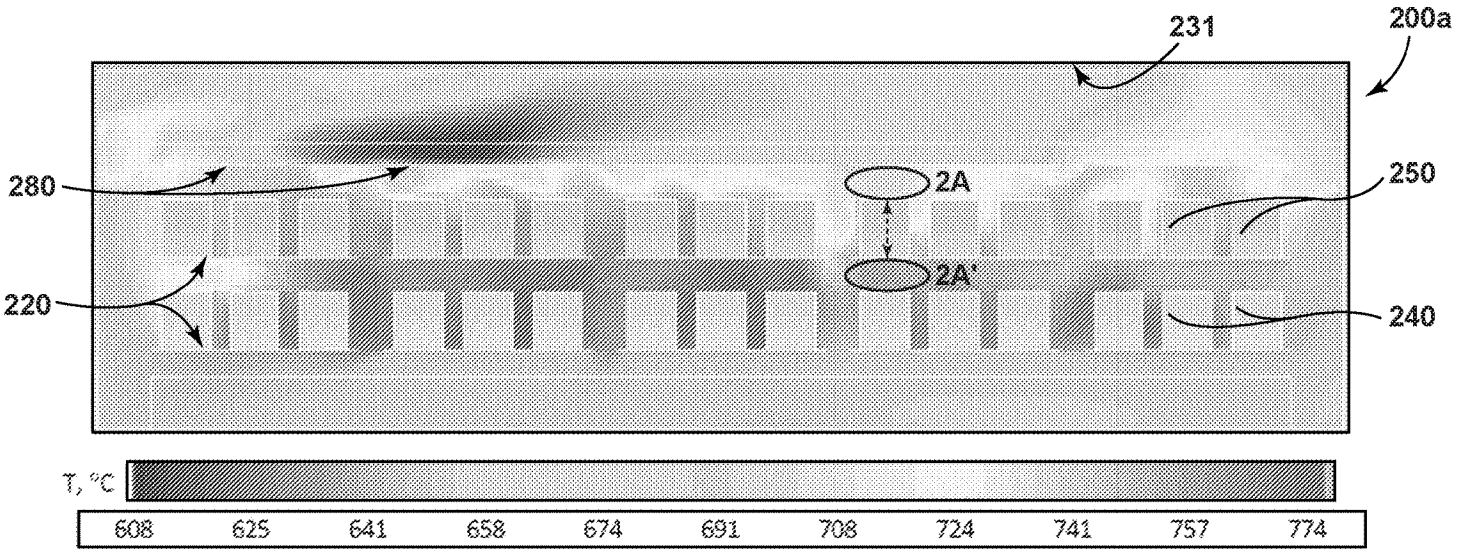
FIG. 2A is a temperature profile schematic of a cross-section of the tunnel kiln and kiln car depicted in FIG. 2 at an axial location in the kiln between burners.
Figure 2B:
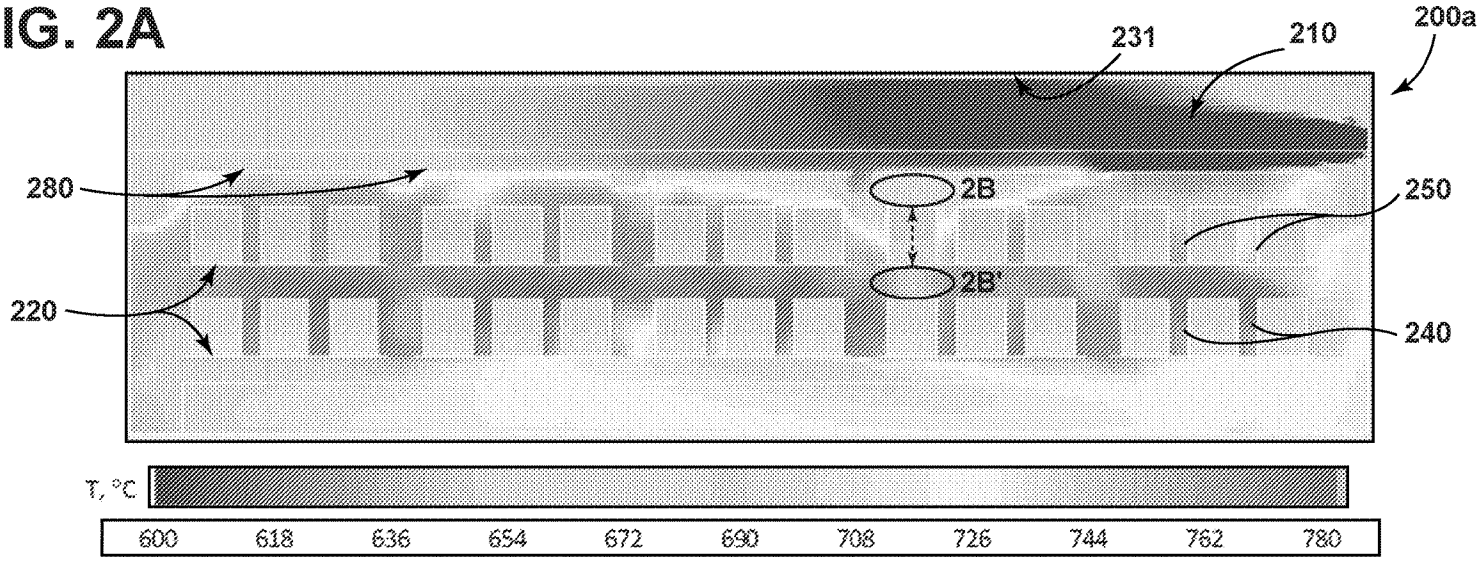
FIG. 2B is a temperature profile schematic of a cross-section of the tunnel kiln and kiln car depicted in FIG. 2 at an axial location in the kiln in proximity to an upper burner.

FIGS. 2A and 2B depict one example of temperature profiles of a cross-section of the tunnel kiln 200*a* and the kiln car 200 at two respective axial locations in the kiln. In FIG. 2A, the kiln 200*a* is loaded with a kiln car 200 having uppermost ceramic green bodies 250 and lowermost green bodies 240. The green bodies 250, 240 rest on respective horizontal plates 220 of the kiln car 200. The axial location within the tunnel kiln 200*a* associated with FIG. 2A is between burners 210, 212. As such, the flame emanating from any of the burners 210, 212 within the kiln 200*a* is not depicted in FIG. 2A. Nevertheless, a maximum temperature gradient of about 50° C. or less is apparent between a region above the uppermost green bodies 250 (e.g., a region subject to gas flow within the kiln) and locations within the bodies themselves (see region 2A to 2A' in FIG. 2A). Although these temperature gradients result in thermal stresses within the bodies, the magnitude of these gradients is significantly reduced in the ceramic green bodies employed in the kiln car 200 (see FIG. 2A) compared to the ceramic green bodies within the kiln car 100 (see FIG. 1A). In particular, the covering element 280 (see FIG. 2A) effectively shields the green bodies, particularly the uppermost ceramic green bodies 250, from gas flow and temperature fluctuations associated with the upper burner 210. These lower temperature gradients, and the associated reduction in thermal stresses, within or in proximity to the ceramic green bodies 250, 240 can be correlated to crack rate reductions associated with a firing process conducted with kiln car 200 in a kiln 200*a* compared to other kiln car designs (e.g., kiln car 100 depicted in FIG. 1).

With regard to FIG. 2B, the axial location within the tunnel kiln 200*a* is in proximity to burner 210. A temperature gradient of about 50° C. or less is apparent between a region above the uppermost green bodies 250 (e.g., a region subject to gas flow within the kiln) and locations within the bodies themselves (see region 2B to 2B' in FIG. 2B). Although these temperature gradients result in thermal stresses within the bodies, the magnitude of these gradients is significantly reduced in the ceramic green bodies employed in the kiln car 200 (see FIG. 2B) compared to the ceramic green bodies within the kiln car 100 (see FIG. 1B) at an axial location in the kiln in proximity to an upper burner. In particular, the covering element 280 (see FIG. 2B) effectively shields the green bodies, particularly the uppermost ceramic green bodies 250, from gas flow and temperature fluctuations associated with the upper burner 210. These lower temperature gradients, and the associated reduction in thermal stresses, within or in proximity to the ceramic green bodies 250, 240 can be correlated to crack rate reductions associated with a firing process conducted with kiln car 200 in a kiln 200*a* compared to other kiln car designs (e.g., kiln car 100 depicted in FIG. 1).

Referring again to FIG. 2 with regard to the spacing 281 (D1), certain aspects of the kiln car 200 set the spacing D1 between about 1 mm and 100 mm between the bottom surface of the covering element 280 and the top surface of the uppermost ceramic green bodies 250 (see FIG. 2). In some aspects, the spacing D1 ranges from 25 mm to 75 mm. In general, increases to the spacing 281 (D1) between the covering element 280 and the uppermost green bodies 250 can reduce the temperature differential observed in all of the ceramic green bodies 240, 250 on the kiln car 200 during the firing process for a given ceramic green body composition, kiln car configuration, kiln configuration and firing schedule. Yet increased spacing 281 can reduce the manufacturing throughput of a given combination of a kiln car 200 and kiln 200*a* by effectively reducing the available ware space (e.g., available locations for ceramic green bodies on the kiln car) within the kiln and on the kiln car. As such, an aspect of the kiln car 200 relates to the selection and optimization of the spacing 281 (D1) associated with the covering element 280 to minimize the temperature differential observed in the ceramic green bodies during firing while not significantly reducing the available ware space on the kiln car 200 and within the kiln 200*a*. For example, an aspect of disclosure relates to modeling the influence of the spacing 281 (D1) on the temperature differential observed in the ceramic green bodies (see, e.g., FIGS. 1A, 1B, 2A, and 2B) over a constant firing schedule, particular green body composition, kiln car 200 configuration and kiln 200*a* configuration.

Still referring to FIG. 2, the minimum spacing 282 (D2) between the burners 210 and the covering element 280 is also an important parameter in controlling the temperature differentials in the ceramic green bodies 240, 250 during a firing process in certain aspects of the kiln car 200. In some implementations of the kiln car 200, the minimum spacing 282 (D2) is set between about 50 mm and about 300 mm. In some aspects, the minimum spacing D2 can range from about 100 mm and about 200 mm. More generally, increases to the minimum spacing 282 (D2) between the covering element 280 and the upper burner 210 can reduce the temperature differential observed in all of the ceramic green bodies 240, 250 on the kiln car 200 during the firing process for a given ceramic green body composition, kiln car configuration, kiln configuration and firing schedule. On the other hand, increases to the minimum spacing 282 can reduce the manufacturing throughput of a given combination of a kiln car 200 and kiln 200*a* by effectively reducing the available ware space (e.g., available locations for ceramic green bodies on the kiln car) within the kiln and on the kiln car. For example, increases to the minimum spacing 282 for a given kiln 200*a* design result in less available space for the kiln car 200 and ware space on the car. As such, an aspect of the kiln car 200 relates to the selection and optimization of the spacing 282 (D2) associated with the covering element 280 to minimize the temperature differential observed in the ceramic green bodies during firing while not significantly reducing the available ware space on the kiln car 200 and within the kiln 200*a*. Accordingly, an aspect of disclosure relates to modeling the influence of the spacing 281 (D1) on the temperature differential observed in the ceramic green bodies (see, e.g., FIGS. 1A, 1B, 2A, and 2B) over a constant firing schedule, particular green body composition, kiln car 200 configuration and kiln 200*a* configuration.

Figure 3:
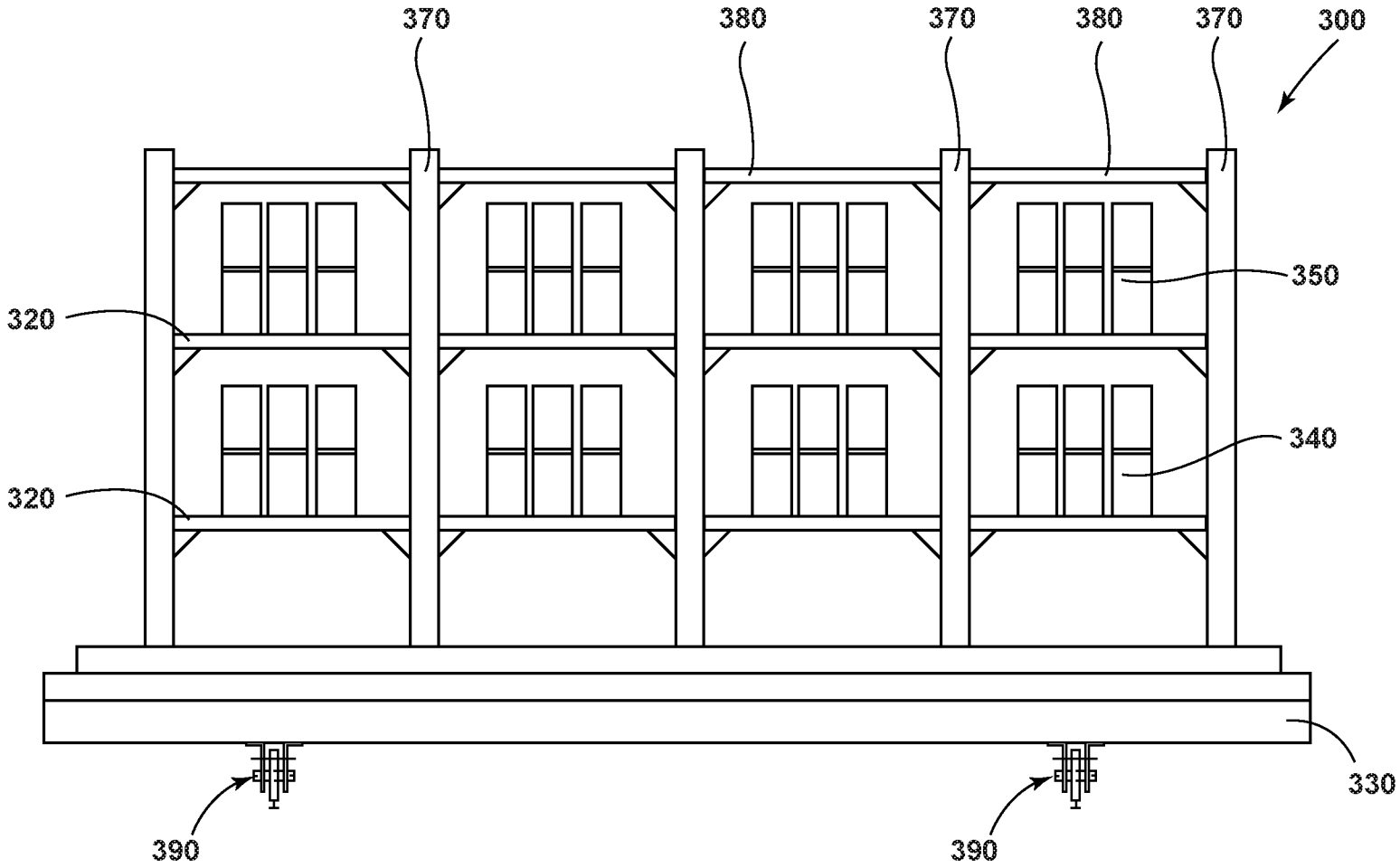
FIG. 3 is a schematic front view of a cross-section of a kiln car holding ceramic green bodies according to a further aspect of the disclosure.

According to a further aspect, the kiln car 300 shown in FIG. 3 may also help to reduce the cracking rates of ceramic green bodies associated with firing processes. Kiln car 300 can be employed in a kiln 200*a*. In particular, FIG. 3 provides a schematic front view of the kiln car 300 holding ceramic green bodies 340, 350. The kiln car 300 comprises a base 330, and wheels 390 coupled to the base 330. Further, the kiln car 300 comprises an uppermost section for holding the uppermost plurality of ceramic green bodies 350 (e.g., during a firing process in the kiln 200*a*). In certain embodiments, the kiln car 300 comprises one or more rows of lowermost ceramic green bodies 340 beneath the green bodies 350.

Referring again to FIG. 3, the kiln car 300 is suitable for use in a kiln 200*a* configured as a periodic kiln, tunnel kiln or the like having a plurality of upper and lower burners (e.g., burners 210, 212) capable of firing ceramic green bodies as outlined in the disclosure. In general, the kiln car 300 and burners 210, 212 are configured such that the lowermost horizontal supporting plate 320 is above the lower burners 212 in the kiln 200*a* and the covering element 380 is beneath the upper burners 210 (see FIGS. 2 and 3) as the kiln car 300 travels in an axial direction within the kiln 200*a*. While the temperature gradients experienced by the ceramic green bodies 340, 350 are not as cyclic in nature when the kiln car 300 is employed in a periodic kiln compared to a tunnel kiln, the kiln car 300 remains advantageous in reducing the magnitude of the temperature gradients experienced by the ceramic green bodies during the firing process. Moreover, the kiln car 300 also provides further manufacturing flexibility for use in a periodic kiln as it possesses less thermal stress sensitivity associated with the distance between the burners and the ware (e.g., ceramic green bodies 340, 350) compared to conventional kiln cars.

As also depicted in FIG. 3, the kiln car 300 also comprises a plurality of vertical members 370 and horizontal supporting plates 320 that rest or are otherwise supported by the members 370. The horizontal supporting plates 320 are for supporting the ceramic green bodies 340, 350 as shown in FIG. 3 during the firing process. Notably, the kiln car 300 comprises a greater quantity of vertical members 370 compared to the quantity of vertical members 270 employed in the kiln car 200. As such, the kiln car 300 may have less capacity for ceramic green bodies compared to the kiln car 200, but each of its green bodies is preferably afforded more shielding from burner flow. Consequently, in some embodiments a kiln car 300 may provide even better temperature uniformity within its ceramic green bodies during a firing process compared to kiln car 200, but with a trade-off in a somewhat reduced capacity. It should therefore be understood that the principles of additional shielding of the ceramic green bodies in the disclosure can be applied to various kiln car configurations, including kiln cars 200 and 300, through the use of covering elements and/or additional vertical members while optimizing ceramic green body capacity.

Figure 4:
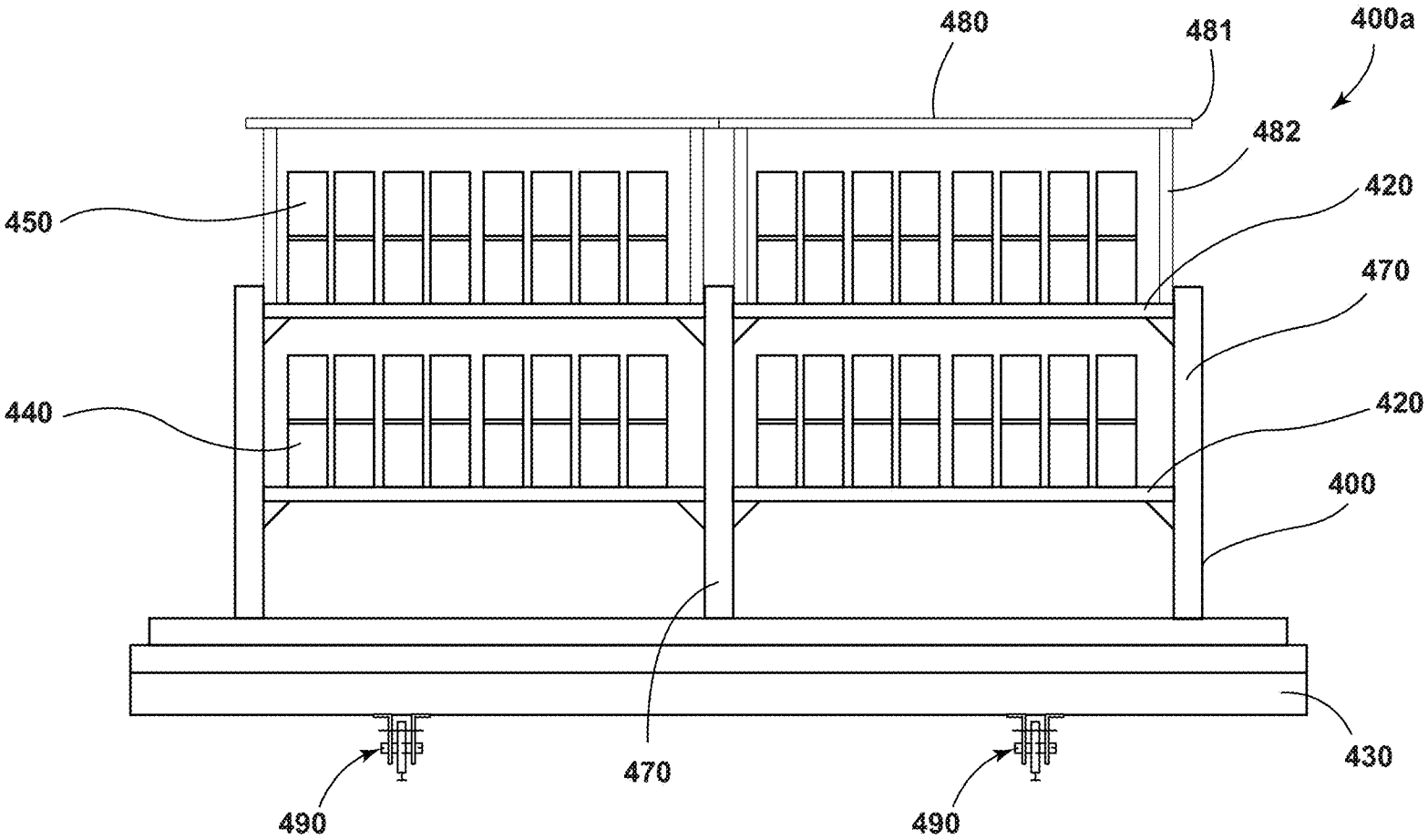
FIG. 4 is a schematic front view of a cross-section of a kiln car assembly holding ceramic green bodies according to another aspect of the disclosure.

Referring to FIG. 4, a schematic front view of a cross-section of kiln car assembly 400*a* holding ceramic green bodies 440, 450 is provided according to another aspect of the disclosure. Kiln car assembly 400*a* depicted in FIG. 4 can be employed in a kiln 200*a* (see FIG. 2) for firing ceramic green bodies. In particular, the kiln car assembly 400*a* comprises a kiln car 400 with an uppermost plurality of ceramic green bodies 450, lowermost green bodies 440, a plurality of vertical members 470, and horizontal supporting plates 420 for supporting the ceramic green bodies 440, 450 during a firing process in the kiln, e.g., kiln 200*a*. The kiln car 400 also comprises a base 430 and wheels 490 coupled to the base 430 to facilitate axial movement of the kiln car assembly 400*a* within a kiln, e.g., kiln 200*a*.

The kiln car assembly 400*a* depicted in FIG. 4 further comprises a covering table 480 that includes a tabletop 481. As depicted in exemplary fashion in FIG. 4, the tabletop 481 can be located between the uppermost ceramic green bodies 450 and the upper burners of the kiln (e.g., upper burners 210 of kiln 200*a* as shown in FIG. 2). In addition, the covering table 480 also comprises a plurality of legs 482 positioned to rest on the uppermost horizontal support plate 420 employed in the kiln car assembly 400*a*. Legs 482 support the covering table 480 and tabletop 481 over the uppermost ceramic green bodies 450.

Still referring to FIG. 4, the covering table 480 of the kiln car assembly 400*a* may perform similar functions as the covering elements 280 and 380 employed in the respective kiln cars 200 and 300 (see FIGS. 2 and 3). Covering table 480 may also be fabricated from the same materials and may possess the same dimensional characteristics as the covering elements 280 and 380. The thickness of the tabletop 481, spacing between the tabletop 481 and the uppermost ceramic green bodies 450 and the spacing between the table 481 and the upper burners (e.g., burners 210) alone or in combination can play a role in reducing the maximum temperature differential in the ceramic green bodies 440, 450 during a firing process to reduce the cracking rate of these bodies.

Kiln car assembly 400*a* depicted in FIG. 4 may be optimized for both throughput and reductions in cracking rate by virtue of the relative independence of the covering table 480 from the kiln car 400. In embodiments where covering table 480 provides no structural support for the green bodies 440, 450 during the firing process, the table 480, table 481 and its legs 482 can all be configured particularly for the purpose of shrouding or otherwise shielding the ceramic green bodies from burner flow-associated temperature non-uniformities to improve cracking rates. Furthermore, covering table 480 may be employed to retrofit a conventional kiln car according to the ceramic green body shielding principles of the disclosure. Covering table 480, including its tabletop 481 and legs 482, may be added to an existing kiln car having "exposed" uppermost ceramic green bodies (e.g., the uppermost ceramic green bodies 50 in the kiln car 100 depicted in FIG. 1).

Figure 5:
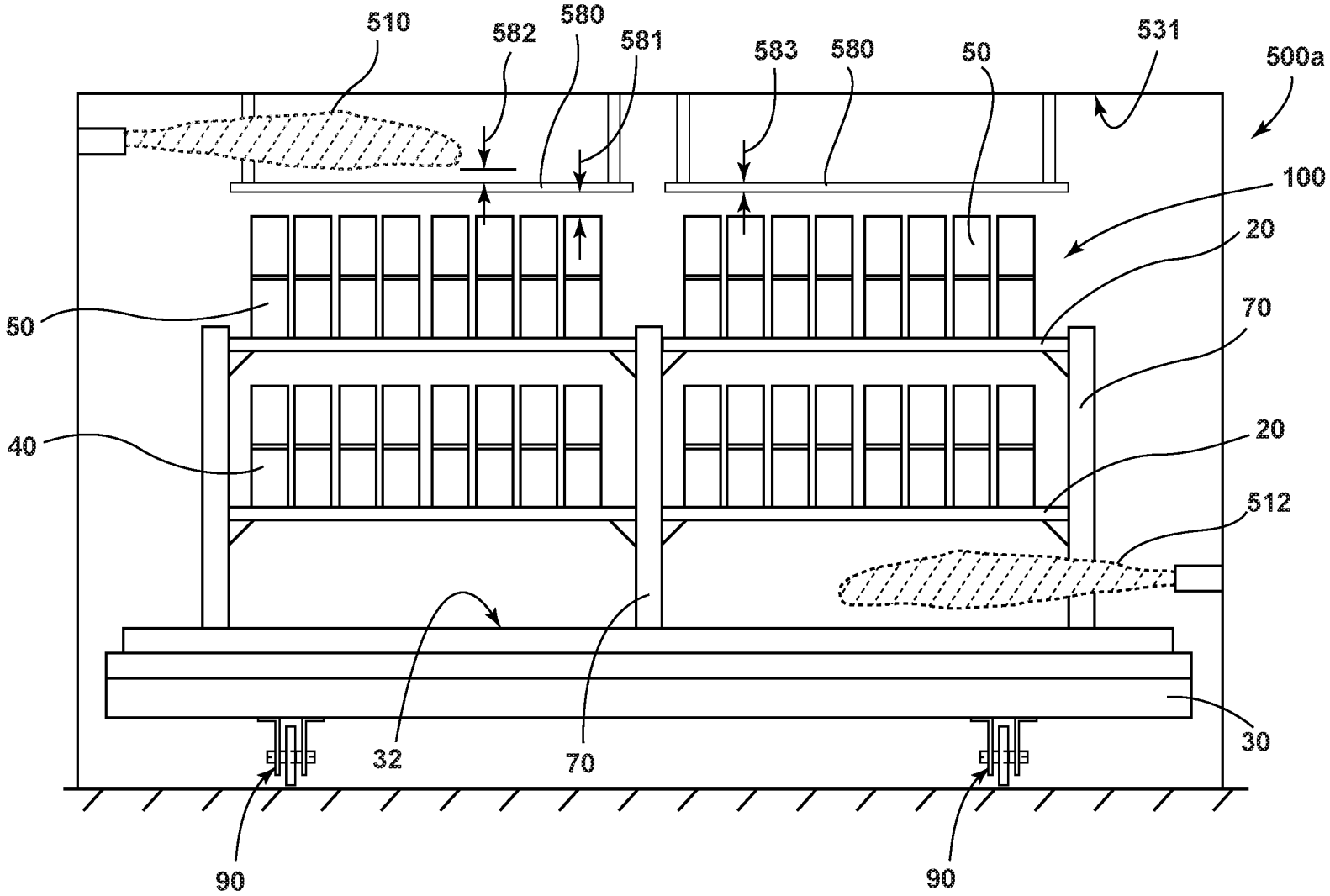
FIG. 5 is a schematic front view of a cross-section of a tunnel kiln with a kiln car holding ceramic green bodies during a firing process according to an aspect of the disclosure.

According to another aspect of the disclosure, a firing kiln 500*a* is depicted in FIG. 5 for firing ceramic green bodies. The firing kiln 500*a* comprises a furnace enclosure having a floor, a ceiling 531 and a plurality of side walls. The firing kiln 500*a* further comprises a plurality of upper burners 510 and lower burners 512, in some embodiments coupled to one or more of the side walls of the kiln. Upper burners 510 may be arranged in proximity to the ceiling 531 and the lower burners 512 may be arranged in proximity to the floor of the kiln 500*a*. The kiln 500*a* also comprises a plurality of hanging plates 580 coupled to the ceiling 531 or at least one of the side walls of the kiln.

Burners 510, 512 and the other components of the kiln 500*a* depicted in FIG. 5 are adapted for firing a batch of ceramic green bodies positioned on a kiln car. As shown in FIG. 5, a kiln car 100 (see FIG. 1) can be employed within the kiln 500*a* with "exposed" uppermost ceramic green bodies 50 and lowermost ceramic green bodies 40. Kiln car 100 can travel in an axial direction within the kiln 500*a* during a firing schedule for the ceramic green bodies 40, 50 positioned on the kiln car.

Referring again to FIG. 5, kiln 500*a* comprises a plurality of hanging plates 580 affixed or otherwise attached to the ceiling 531 or at least one side wall. The hanging plates 580 are located between the uppermost ceramic green bodies positioned on the kiln car within the kiln 500*a* and the upper burners 510. In some embodiments, hanging plates 580 are located such that each upper burner 510 is at least partially enclosed by at least one of the hanging plates 580. In some embodiments, kiln 500*a* may comprise one or more upper burners 510 in a more exposed configuration without a corresponding hanging plate.

Referring again to FIG. 5, hanging plates 580 possess a thickness 583. In some embodiments, the thickness 583 ranges from about 1 mm to about 25 mm, and in other embodiments between about 10 and 20 mm. Hanging plates 580 can be configured with a spacing 581 (D1) between the uppermost ceramic green bodies (e.g., green bodies 50 positioned on a kiln car 100) and/or a minimum spacing 582 (D2) between the plate 580 and the upper burners 510 of the kiln 500*a*. In some embodiments, the spacing 581 (D1) can be set between about 1 mm and 100 mm in certain aspects, and in other embodiments between about 25 mm and about 75 mm. In some embodiments, spacing 582 (D2) can be set between about 50 mm and 300 mm, and in other embodiments between about 100 mm and 200 mm.

In some embodiments, the hanging plates 580 of the kiln 500*a* perform the same functions as the covering elements 280 and 380 employed in the respective kiln cars 200 and 300 (see FIGS. 2 and 3) and the covering table 480 employed in the kiln car assembly 400*a*. Hanging plates 580 can be fabricated from the same or similar materials and may possess the same or similar dimensional characteristics as the covering elements 280 and 380 and the covering table 480. In addition, the thickness 583 of each hanging plate 580, the spacing 581 (D1) between the plate 580 and the uppermost ceramic green bodies (e.g., green bodies 50) and the minimum spacing between the hanging plate 580 and the upper burners 510 alone or in combination can play a role in reducing the maximum temperature differential in the ceramic green bodies positioned on a kiln car (e.g., kiln car 100) traveling through the kiln 500*a* during a firing process to reduce the cracking rate of these bodies.

EXAMPLE

Figure 6:
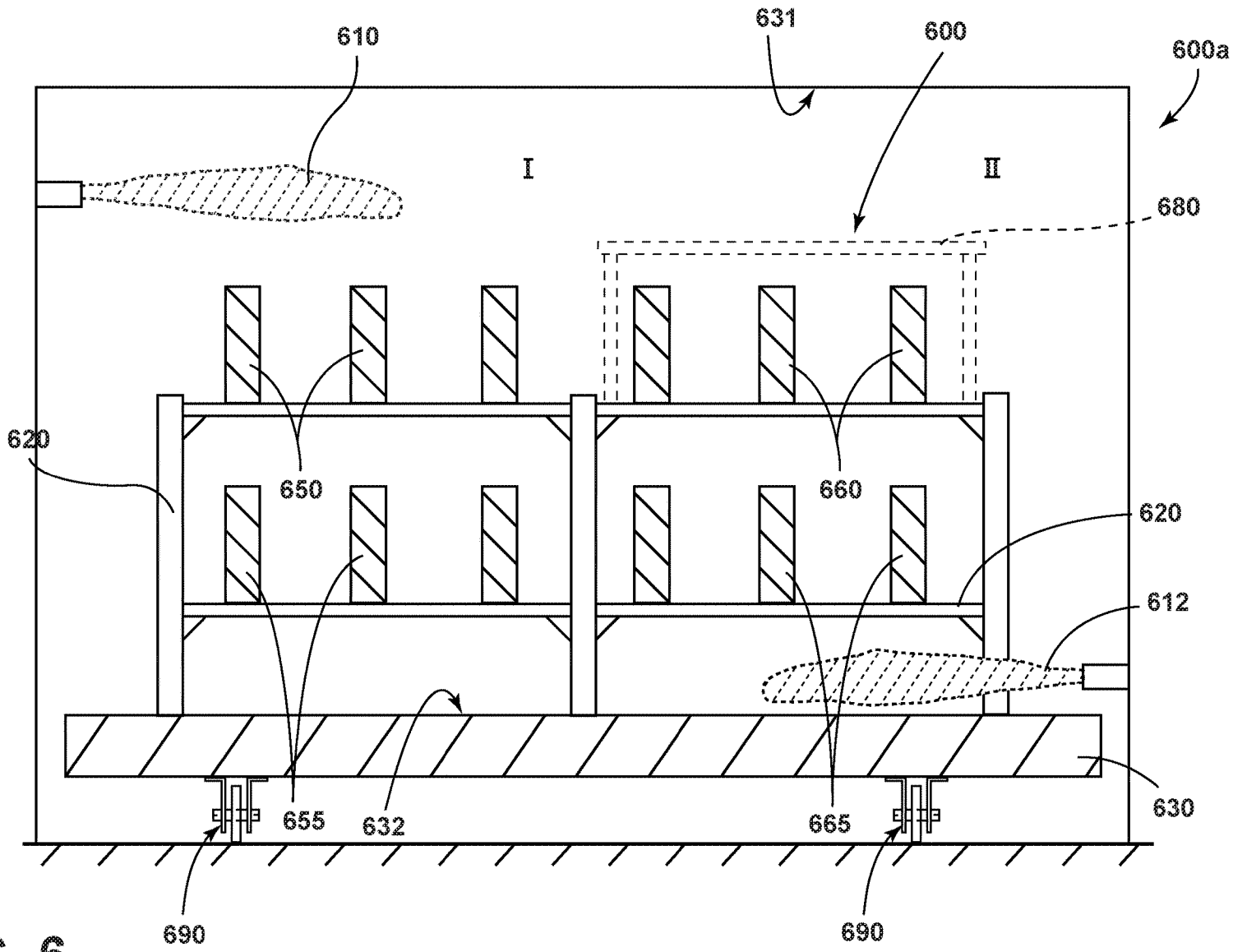
FIG. 6 is a schematic front view of a cross-section of a tunnel kiln with a kiln car holding ceramic green bodies during a firing process according to an additional aspect of the disclosure.

Referring to FIG. 6, two separate firing runs were conducted with a kiln car 600 within a firing kiln 600*a*. The firing kiln 600*a* has a ceiling 631, side walls, a floor, and possesses a plurality of upper burners 610 and a plurality of lower burners 612 affixed to the side walls. The kiln car 600 comprises horizontal support plates 620 for supporting ceramic green bodies during firing runs, vertical members 670, a base 630, and wheels 690 coupled to the base 630 to facilitate axial movement of the kiln car within a kiln. The two firing runs were conducted by periodically introducing the flame from burners 610 and 612 to simulate movement of the kiln car 600 within a tunnel kiln. In addition, each firing run was conducted with uppermost ceramic green bodies 650 and 660 located in positions I and II, respectively, on the kiln car 600. Lowermost ceramic green bodies 655 and 665 were also included on the kiln cars 600 in each of the runs to make them more representative of a manufacturing firing schedule. The first run (Run No. 1) was conducted with the uppermost ceramic green bodies 650 and 660 with kiln car 600 in an "exposed" configuration. The second run (Run No. 2) was conducted with the uppermost ceramic green bodies 650 in an "exposed" configuration on the kiln car 600 and the uppermost ceramic green bodies 660 shielded by a covering table 680 (e.g., comparable in construction to the covering table 480 depicted in FIG. 4).

TABLE 1 below provides the results from Run Nos. 1 and 2. In Run No. 1, the uppermost ceramic green bodies 650 in Region I (i.e., relatively close proximity to burner 610) exhibited a crack rate of 33% and the uppermost green bodies 660 in Region II (i.e., located farther from burner 610 than the green bodies in Region I) exhibited a crack rate of 100%. That is, 2 out of the 6 ceramic green bodies 650 were cracked after completion of Run No. 1, and 6 out of 6 ceramic green bodies 660 were cracked after completion of Run No. 1. In Run No. 2, the uppermost ceramic green bodies 650 in Region I again exhibited a crack rate of 33% and the uppermost green bodies 660 in Region II shielded with the covering table 680 exhibited a crack rate of 40%. That is, 2 out of the 6 ceramic green bodies 650 were cracked after completion of Run No. 2, and 2 out of 5 ceramic green bodies 660 were cracked after completion of Run No. 2. Together, these results demonstrate that the use of the covering table 680 reduced the crack rate of the ceramic green bodies from 100% to 40%, indicative of a reduction in the maximum temperature differential within the green bodies during a firing run.

TABLE 1

| | Run No. | N green bodies | Cracks | Crack rate |
|---|---|---|---|---|
| Green bodies (Region I) | 1 | 6 | 2 | 33% |
| Green bodies (Region II - exposed) | 1 | 6 | 6 | 100% |
| Green bodies (Region I) | 2 | 6 | 2 | 33% |
| Green bodies (Region II - shielded) | 2 | 5 | 2 | 40% |

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A kiln car for a firing kiln having a plurality of upper burners, comprising:

a kiln car comprising an uppermost section for holding an uppermost plurality of ceramic green bodies during a firing process in the kiln, a plurality of vertical members, and a horizontal supporting plate for supporting the ceramic green bodies during the firing process, wherein the uppermost section comprises a covering element located between the uppermost plurality of ceramic green bodies and the upper burners, wherein the covering element has a thickness between about 1 mm and about 25 mm, wherein the covering element is spaced above the uppermost plurality of ceramic green bodies by a distance D1, D1 set between about 1 mm and about 100 mm, and wherein the covering element is spaced from the upper burners by a minimum distance D2, D2 set between about 50 mm and about 300 mm.

2. The kiln car according to claim 1, wherein the ceramic green bodies are configured for firing into a honeycomb-shaped structural body for treating vehicular emissions.

3. The kiln car according to claim 2, wherein the plurality of vertical members, the horizontal supporting plate and the covering element each comprise a silicon carbide composition.

4. The kiln car according to claim 1, wherein the covering element is spaced by the distance D1 and the minimum distance D2 to control a maximum temperature differential between a topmost surface of the uppermost plurality of ceramic green bodies and a region in the kiln above the topmost surface of the uppermost plurality of ceramic green bodies, and further wherein the maximum temperature differential is 100° C. or less.

5. A kiln car assembly for a firing kiln having a plurality of upper burners, comprising:

a kiln car comprising an uppermost plurality of ceramic green bodies, a plurality of vertical members, and a horizontal supporting plate for supporting the ceramic green bodies during a firing process in the kiln; and a covering table comprising a tabletop located between the uppermost plurality of ceramic green bodies and the upper burners, and a plurality of legs positioned on the horizontal supporting plate, wherein the tabletop has a thickness between about 1 mm and about 25 mm, wherein the tabletop is spaced above the uppermost plurality of ceramic green bodies by a distance D1, D1 set between about 1 mm and 100 mm, and wherein the tabletop is spaced from the upper burners by a minimum distance D2, D2 set between about 50 mm and about 300 mm.

6. The kiln car assembly according to claim 5, wherein the ceramic green bodies are configured for firing into a honeycomb-shaped structural body for treating vehicular emissions.

7. The kiln car assembly according to claim 6, wherein the plurality of vertical members, the horizontal supporting plate and the covering table each comprise a silicon carbide composition.

8. The kiln car assembly according to claim 5, wherein the tabletop is spaced by the distance D1 and the minimum distance D2 to control a maximum temperature differential between a topmost surface of the uppermost plurality of ceramic green bodies and a region in the kiln above the topmost surface of the uppermost plurality of ceramic green bodies, and further wherein the maximum temperature differential is 100° C. or less.

9. A firing kiln for firing ceramic green bodies, comprising:

a furnace enclosure having a floor, a ceiling and a plurality of side walls;

a plurality of upper burners arranged in proximity to the ceiling; and a plurality of hanging plates coupled to the ceiling or at least one of the side walls;

wherein the burners and the enclosure are adapted for firing a batch of ceramic green bodies positioned on a kiln car, the batch comprising an uppermost plurality of ceramic green bodies, and wherein the plurality of hanging plates is located between the uppermost plurality of ceramic green bodies and the respective plurality of upper burners such that each upper burner is at least partially enclosed by one of the hanging plates, wherein the hanging plate has a thickness between about 1 mm and 25 mm, wherein each hanging plate is spaced above the uppermost plurality of ceramic green bodies by a distance D1, D1 set between about 1 mm and 100 mm, and wherein each hanging plate is spaced from the upper burner by a distance D2, D2 set between about 50 mm and about 300 mm.

10. The firing kiln according to claim 9, wherein each hanging plate comprises a silicon carbide composition.

11. The firing kiln according to claim 9, wherein each hanging plate is spaced by the distance D1 and the minimum distance D2 to control a maximum temperature differential between a topmost surface of the uppermost plurality of ceramic green bodies and a region in the kiln above the topmost surface of the uppermost plurality of ceramic green bodies, and further wherein the maximum temperature differential is 100° C. or less.

* * * * *